United States Patent [19]

Mörz

[11] Patent Number: 4,622,524

[45] Date of Patent: Nov. 11, 1986

[54] DUAL BAND POLARIZATION FILTER COMPRISING ORTHOGONALLY ORIENTED FIN-TYPE CONDUCTORS

[75] Inventor: Günter Mörz, Ludwigsburg, Fed. Rep. of Germany

[73] Assignee: ANT Nachrichtentechnik GmbH, Backnang, Fed. Rep. of Germany

[21] Appl. No.: 704,097

[22] Filed: Feb. 22, 1985

[30] Foreign Application Priority Data

Feb. 24, 1984 [DE] Fed. Rep. of Germany ..... 3406641

[51] Int. Cl.[4] ..... H01P 1/161; H01P 1/213

[52] U.S. Cl. ..... 333/126; 333/135; 333/21 A; 333/204; 370/30

[58] Field of Search ..... 333/126, 134, 135, 21 A, 333/204, 208; 370/24, 30, 37, 38, 19, 69.1, 123; 455/81, 82

[56] References Cited

U.S. PATENT DOCUMENTS

| | | | |
|---|---|---|---|
| 3,914,713 | 10/1975 | Konishi et al. | 333/208 X |
| 3,978,434 | 8/1976 | Mörz . | |
| 4,047,128 | 9/1977 | Morz | 333/21 A X |
| 4,467,294 | 8/1984 | Janky et al. | 333/135 X |

*Primary Examiner*—Paul Gensler

*Attorney, Agent, or Firm*—Spencer & Frank

[57] ABSTRACT

A dual band polarization filter can be produced at low expense includes two hollow waveguide sections arranged one behind the other. A fin-type conductor structure is provided in each hollow waveguide section. The fin-type conductor structures produce polarization and frequency band separation of the signals fed into the hollow waveguide sections, these signals being associated with two different frequency bands and two polarization directions.

10 Claims, 2 Drawing Figures

DUAL BAND POLARIZATION FILTER COMPRISING ORTHOGONALLY ORIENTED FIN-TYPE CONDUCTORS

BACKGROUND OF THE INVENTION

The present invention relates to a dual band polarization filter which includes a hollow waveguide with waveguide couplings for four signals, means being provided to effect frequency and polarization separation of the four signals. Each of the four signals has a frequency in one of two different frequency bands and is polarized in one of two orthogonal directions.

Such a dual band polarization filter is disclosed in U.S. Pat. No. 3,978,434. This filter is equipped with relatively complicated means for separating the frequency bands and polarizations to meet particularly high demands, imposed in particular with connection with satellite radio communications, with respect to high polarization decoupling, low losses, and high decoupling between the signal paths of different frequency bands.

The extremely high demands to be met in connection with satellite radio communications by a dual band polarization filter can, however, be reduced for a dual band polarization filter used in directional radio. Therefore, a less complicated dual band polarization filter than the one disclosed in U.S. Pat. No. 3,978,434 would suffice for use in directional radio.

SUMMARY OF THE INVENTION

It is the object of the present invention to provide a dual band polarization filter of the above-mentioned type which can be made at the least possible expense, but which nevertheless provides good characteristics with respect to polarization decoupling, attenuation, and frequency band decoupling.

This is accomplished in the present invention by providing a first hollow waveguide section in which there is a fin-type conductor structure oriented parallel to one of the polarization directions. The structure in the first waveguide section is provided with branching signal paths and with frequency selective elements so as to separate the signals of one polarization direction with respect to their frequencies and feed them to two waveguide outputs. In a second hollow waveguide section, there is provided a second fin-type conductor structure. The second structure is oriented parallel to the other polarization direction and is also provided with branching signal paths and frequency selective elements so as to separate the signals of the other polarization direction with respect to their frequencies and feed them to two further waveguide outputs.

DESCRIPTION OF THE PREFERRED EMBODIMENTS

Figure 1:
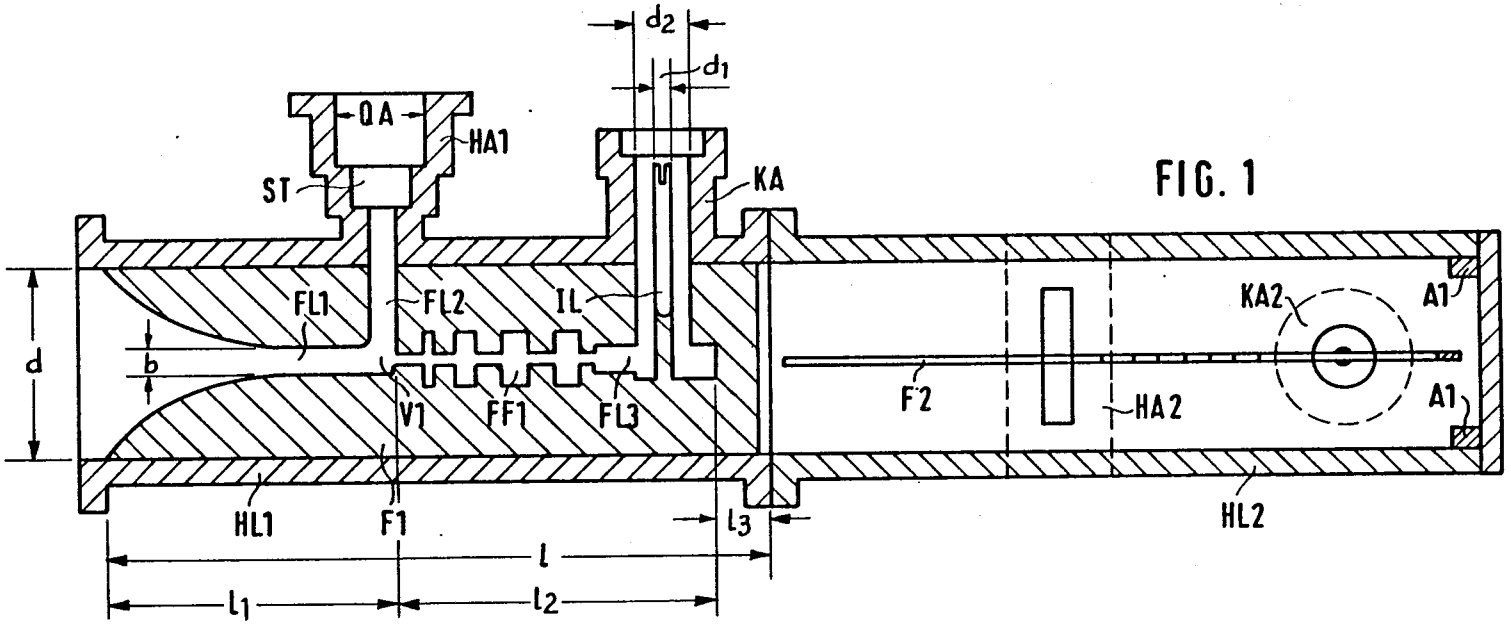
FIGS. 1 and 2 are longitudinal sectional views of two embodiments of the dual band polarization filter of the present invention, the embodiments having different fin-type conductor structures.

The dual band polarization filter shown in FIG. 1 is provided with a doubly polarized hollow waveguide section HL1 having, for example, a square or round cross section. The term "doubly polarized" as used herein means that waveguide section HL1 is configured to accept waves polarized in two orthogonal directions, such as vertically polarized waves and horizontally polarized waves. In a longitudinal sectional plane passing through the longitudinal axis of hollow waveguide section HL1, there is disposed a fin-type conductor structure F1. The fin-type conductor structure F1 may be fabricated from an electrically conductive metal sheet or may be metalized onto a dielectric substrate.

This fin-type conductor structure F1 in hollow waveguide section HL1 serves to couple in only the signals of one polarization direction. Therefore, fin-type conductor structure F1 is oriented parallel to this polarization direction.

The transition from hollow waveguide section HL1 to fin-type signal path FL1 is effected by steady (or stepwise) widening of the fin-type conductor to the hollow waveguide diameter. This fin-type signal path FL1 couples in the signals of two frequency bands (e.g., 6 GHz and 4 GHz) propagating within hollow waveguide section HL1 and feeds them to a branch point V1, where fin-type signal path FL2 branches off from fin-type signal path FL3. Signal path FL2 leads to a hollow waveguide output HA1. Signal path FL3 is provided with a lowpass filter structure FF1.

The signal of the higher frequency band (6 GHz) is coupled by fin-type signal path FL2 to the hollow waveguide output HA1, which is provided with a step transformer ST having high pass filter characteristics due to its dimensions. Step transformer ST serves to provide impedance transformation from fin-type signal path FL2 to connecting cross section QA of hollow waveguide output HA1. Assuming that transformer ST is rectangular in cross section, it is desirable to narrow the broad side of the rectangle so that the high pass filter effect is augmented.

After low pass filter structure FF1, the signal of the lower frequency band (4 GHz) is coupled out of fin-type signal path FL3 by way of an internal conductor IL of coaxial line output KA1.

The first hollow waveguide section HL1 is followed by a second hollow waveguide section HL2 which is either doubly polarized like the first hollow waveguide section or has such a cross-sectional configuration that only signals of a single polarization can propagate therein. The second hollow waveguide section HL2 is similarly equipped with a fin-type conductor structure F2, with the only difference being that fin-type conductor structure F2 in hollow waveguide section HL2 is axially rotated by 90° with respect to fin-type conductor structure F1 in hollow waveguide section HL1, so that the signals of the other polarization, which is orthogonal to the polarization accepted by fin-type conductor structure F1, are coupled into fin-type conductor structure F2. Hollow waveguide output HA2, which has high pass characteristics, receives the signal of the higher frequency band (6 GHz) while coaxial line output KA2 receives the signal of the lower frequency band (4 GHz). Both signal outputs HA2 and KA2 have the same dimensions as the corresponding signal outputs HA1 and KA1 of hollow waveguide section HL1.

Figure 2:
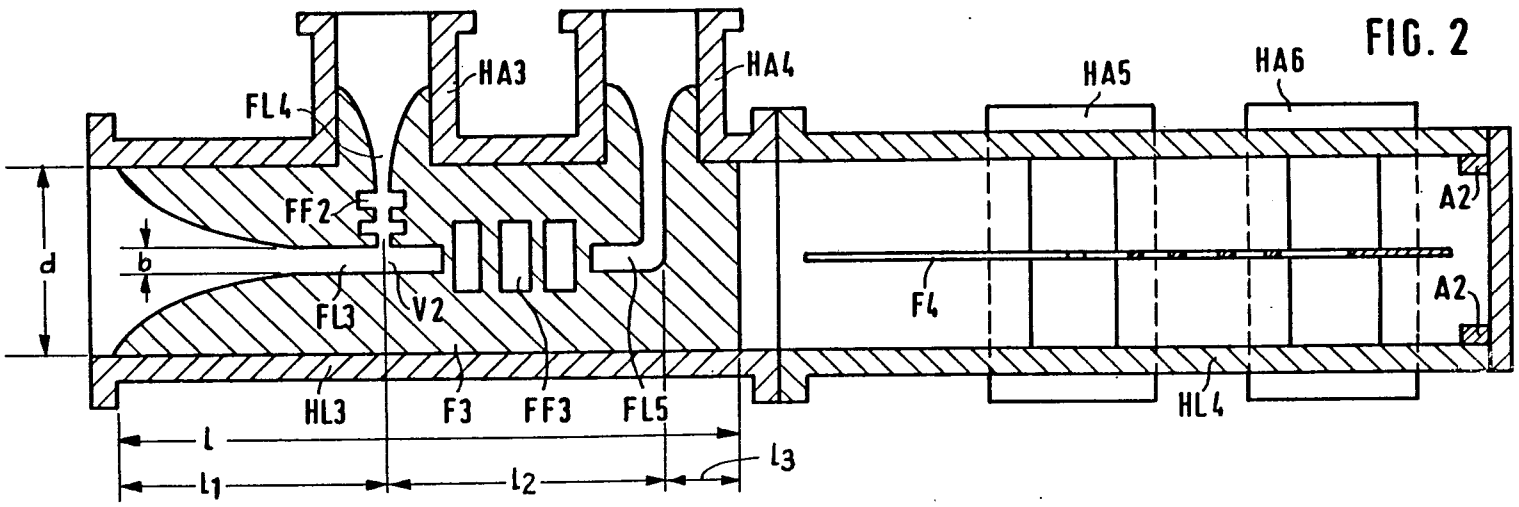

The second embodiment of the dual band polarization filter shown in FIG. 2 is similar to the first embodiment shown in FIG. 1 except for the manner of frequency band separation by fin-type conductor structures F3 and F4 in hollow waveguide sections HL3 and HL4.

At branch point V2, fin-type signal path FL3, which carries both frequency bands, branches out into fin-type signal path FL4 and fin-type signal path FL5. Signal path FL4 is provided with low pass structure FF2 and signal path FL5 is provided with bandpass structure FF3. Fin-type signal path FL4 couples the signal of the lower frequency band (4 GHz) to hollow waveguide output HA3 and fin-type conductor FL5 couples the signal of the higher frequency band (6 GHz) to hollow waveguide output HA4. All transitions from fin-type signal paths to hollow waveguides are made by way of steady (or stepwise) widening of the fin-type signal paths to the walls of the hollow waveguides.

The fin-type conductor structure F4 provided in second hollow waveguide section HL4 has the same shape as fin-type conductor structure F3 in the first hollow waveguide section HL3. It couples the signal of the lower frequency band or that of the high frequency band to hollow waveguide outputs HA5 and HA6, respectively.

In order for the doubly polarized waves which are coupled into the first hollow waveguide section HL1 or HL3 not to excite interference waves in the second hollow waveguide section HL2 or HL4, respectively, the fin-type conductor structure should be selected to be correspondingly long at its end. The fin-type conductor structure acts like a load in the hollow waveguide (comparable to a ridged waveguide) so that interfering higher modes are attenuated. Interference waves which might still exist are eliminated by absorption bodies A1 and A2 provided at the ends of the second hollow waveguide section HL2 and HL4.

The invention permits various modifications with respect to the filter structures. It is possible, for example, to have two bandpass structures, or one bandpass structure and one band reject structure, branch off from branch points V1 and V2.

Contrary to the above-described embodiments, hollow waveguide sections HL1, HL2, HL3, and HL4 may be constructed as waveguides having two pairs of ridges. Then the transition from hollow waveguide to fin-type conductor would not be gradual but abrupt.

Following are the relevant dimensions of specific exemplary embodiments of the dual band polarization filter shown in FIGS. 1 and 2: The length l of the fin-type conductor structures F1, F2, F3, and F4 is four to five times $\lambda$. The length $l_1$ of the fin-type signal paths FL1 and FL3 is $l_1 \approx 2\lambda$. The length $l_2$ of the fin-type signal paths FL3 and FL5 with respective filter structures FF1 and FF3 is $l_2 \approx 2\lambda$. The length $l_3$ of the end portions of the fin-type conductor structures is $l_3 \geqq \lambda/2$. The width b of the fin-type signal paths is $b \leqq \lambda/8$ ($\lambda \approx 7$ cm is the wavelength of the lower frequency 4 GHz). The diameter d of the round cross section of the hollow waveguides HL1, HL2, HL3, and HL4 is d=54 mm.

The dimensions of the rectangular cross sction of the hollow waveguide outputs HA1, HA2, HA4, and HA6 are 15 mm×34 mm. The diameter $d_1$ of the inner conductor and the diameter $d_2$ of the outer conductor of the coaxial waveguide outputs KA1 and KA2 are $d_1=7$ mm and $d_2=16$ mm. The dimensions of the rectangular cross section of the hollow waveguide outputs HA3 and HA5 are 29 mm×58 mm.

The fin-type conductor structures F2 and F4, of which the side views are not shown in FIGS. 1 and 2, have the same dimensions as the fin-type conductor structures F1 and F3.

It will be understood that the above description of the present invention is susceptible to various modifications, changes and adaptations, and the same are intended to be comprehended within the meaning and range of equivalents of the appended claims.

What I claim is:

1. A dual band polarization filter for separating four signals by frequency and polarization, one pair of said signals being polarized in one of two orthogonal directions and another pair of said signals being polarized in the other of said two orthogonal directions, one signal of each pair having a frequency in one of two different frequency bands and the other signal of each pair having a frequency in the other of said two different frequency bands, comprising:

a first hollow waveguide section having two waveguide outputs;

a first fin-type conductor structure disposed in said first hollow waveguide section, said first fin-type conductor structure being oriented parallel to one of said two orthogonal directions and being configured to provide branching signal paths and frequency selective elements with which the signals polarized in said one of said two orthogonal directions are separated as to their frequencies and are fed to said two waveguide outputs;

a second hollow waveguide section having two further waveguide outputs; and a second fin-type conductor structure disposed in said second hollow waveguide section, said second fin-type conductor structure being oriented parallel to the other of said two orthogonal directions and being configured to provide branching signal paths and frequency selective elements with which the signals polarized in said other of said two orthogonal directions are separated as to their frequencies and are fed to said two further waveguide outputs.

2. A dual band polarization filter according to claim 1, wherein said hollow waveguide sections are configured so that fields polarized in either of said two orthogonal directions are able to propagate in both hollow waveguide sections.

3. A dual band polarization filter according to claim 1, wherein said first hollow waveguide section receives all four signals and is configured so that fields polarized in either of said two orthogonal directions propagate therein, and wherein said second hollow waveguide section is mounted subsequent to said first section and is configured so that only a field polarized in one of said two orthogonal directions propagates therein.

4. A dual band polarization filter according to claim 1, wherein at least one of said fin-type conductor structures comprises an electrically conductive metal sheet.

5. A dual band polarization filter according to claim 1, wherein each of said hollow waveguide sections has an inner wall, and wherein each of said fin-type conductor structures has a transition region which steadily widens to the inner wall of hollow waveguide section in which the fin-type conductor structure is disposed.

6. A dual band polarization filter according to claim 5, wherein at least one of said fin-type conductor structures comprises an electrically conductive metal sheet.

7. A dual band polarization filter according to claim 1, wherein said first and second hollow waveguide sections are elongated and are mounted adjacent one another so that a common axis runs through both, wherein said first fin-type conductor element is substantially flat and is disposed in said first hollow waveguide section along a first plane in which said common axis lies, and wherein said second fin-type conductor element is substantially flat and is disposed in said second hollow waveguide section along a second plane in which said common axis lies, said second plane being substantially perpendicular to said first plane.

8. A dual band polarization filter according to claim 7, wherein said first plane intersects said two waveguide outputs of said first waveguide section, and wherein said second plane intersects said two waveguide outputs of said second waveguide section.

9. A dual band polarization filter according to claim 1, further comprising an end wall mounted on said second hollow waveguide section, and at least one electromagnetic radiation absorption body mounted within said second hollow waveguide section adjacent said end wall.

10. A dual band polarization filter according to claim 1, wherein said first and second fin-type conductor structures are configured substantially identically.

* * * * *